US006242676B1

(12) United States Patent
Romero

(10) Patent No.: US 6,242,676 B1
(45) Date of Patent: Jun. 5, 2001

(54) STRINGED INSTRUMENT SLIDE

(76) Inventor: Gary P. Romero, P.O. Box 372, Antonito, CO (US) 81120

( * ) Notice: Subject to any disclaimer, the term of this patent is extended or adjusted under 35 U.S.C. 154(b) by 0 days.

(21) Appl. No.: 09/451,500

(22) Filed: Nov. 30, 1999

Related U.S. Application Data

(60) Provisional application No. 60/110,674, filed on Dec. 2, 1998.

(51) Int. Cl.[7] ..... G10D 3/00
(52) U.S. Cl. ..... 84/315; 84/318; 84/319
(58) Field of Search ..... 84/315, 318, 319, 84/321, 322; D17/99

(56) References Cited

U.S. PATENT DOCUMENTS

| | | | |
|---|---|---|---|
| D. 360,647 | 7/1995 | Jimenez | D17/20 |
| 1,618,884 | 2/1927 | Meyer . | |
| 2,026,354 | 12/1935 | Mihalek | 84/319 |
| 3,386,325 | 6/1968 | Smith | 84/319 |
| 3,822,629 | 7/1974 | Smith | 84/319 |
| 4,092,894 | 6/1978 | Clough, Jr. | 84/319 |
| 4,328,733 | 5/1982 | Smith | 84/319 |
| 5,488,891 | 2/1996 | Baker | 84/319 |
| 5,492,046 | 2/1996 | Jimenez | 84/319 |

FOREIGN PATENT DOCUMENTS

| | | |
|---|---|---|
| 104766 | 8/1938 | (AU) . |
| 2596188 | 3/1986 | (FR) . |

*Primary Examiner*—Robert E. Nappi
*Assistant Examiner*—Kim Lockett
(74) *Attorney, Agent, or Firm*—Peacock, Myers & Adams

(57) ABSTRACT

A slide for stringed instruments with a bend extension and a finger tab. The slide allows for instantaneous switching between fingered play and slide play.

24 Claims, 6 Drawing Sheets

STRINGED INSTRUMENT SLIDE

CROSS-REFERENCE TO RELATED APPLICATIONS

This application claims the benefit of the filing of U.S. Provisional Patent Application Ser. No. 60/110,674, entitled "Guitar Slide", filed on Dec. 2, 1998, and the specification thereof is incorporated herein by reference.

BACKGROUND OF THE INVENTION

1. Field of the Invention (Technical Field)

The present invention relates to a novel slide apparatus for stringed musical instruments, especially guitars.

2. Background Art

A popular method of playing stringed instruments, and guitars in particular, involves using a slide to create unique tonal qualities and chords. Many types of slides have been developed that were intended for overhead, or Hawaiian-style guitar playing. Examples of these include Smith-325; Smith-733; Clough-894; Smith-629; Mihalek-354; Meyer-884; and Marshall-766. Historically, players even used objects such as sockets (from socket wrenches) and surplus urine testing bottles. These inventions have the disadvantage of interfering with traditional fingering of the fretboard, which is of special concern with acoustic nylon, steel six string, electric six or seven string, or Spanish-style guitars.

To remedy the problems encountered with playing such guitars with a slide, others developed variations of the "Hawaiian slide." Such inventions include Mauceri-188, disclosing a ring having a flat extended portion on part of the circumference; Jimenez 647 and 046, disclosing a slide comprising a finger ring having a rigid rail extension attached to and extending directly from the ring circumference; and Baker-891, disclosing a tapered bar having a rubber or felt damper, attached to a ring. These slides, however, rotate under the fingers excessively, thereby interfering with normal play and comfort. In addition, the motions required to place the slide in playing position, and remove Ht from playing position, are comparatively time- and labor-intensive, and result in the disruption of play.

Still other slides are designed to fit completely around one finger, covering substantially the entire length. These have been designed from bottlenecks, and more recently, from Pyrex, chrome, or brass. These have the obvious disadvantage of limiting the player to encumbered fingered, or pure slide play.

The present invention successfully addresses these problems with a novel construction that results in production of a wide variety of musical effects with no loss of timing or tonality.

SUMMARY OF THE INVENTION (DISCLOSURE OF THE INVENTION)

The present invention is of an apparatus for slide-play of a stringed instrument, comprising a finger ring, a bar support rail attached to side of the finger ring, a slide bar attached to the bar support rail, a bend extension rising upward from the slide bar and integral to the slide bar, and a finger tab adjacent to the finger ring and extending laterally from the finger ring. In the preferred embodiment, the finger ring comprises a sizably adjustable band, and more preferably an incomplete circumference. The bar support rail is preferably inherent with said finger ring, and preferably comprises a triangularly pointed slope at the end opposite the finger ring. The bar preferably comprises a solid cylindrical bar, and preferably is attached by at least 2 points to the bar support rail, and alternatively is attached along the entire length of the bar support rail. Preferably, attachment to the bar support rail comprises solder, bronzing or brazing. Preferably, the slide bar is integral with the bar support rail. In a preferred embodiment, the bend extension angles upward proximal to the finger ring, and the finger tab is integral with the bar support rail. Preferably, the finger tab is adjustable, and preferably extends at an angle of approximately 90° to the slide bar. The present invention preferably comprises at least one composition selected from steel, chrome, brass, sheet metal, glass, ceramics, compound plastics, or other metals.

The present invention is also of a method of playing a stringed instrument with a slide, comprising placing a slide comprising a finger tab and bend extension on a finger of the hand that utilizes the fretboard; engaging the slide on the fretboard; and disengaging the slide to allow for fingered playing. In the preferred embodiment, a slide attached to a finger ring, preferably an adjustable finger ring, is placed on a finger. Preferably, the finger ring is adjusted. The slide is preferably placed with the bend extension extending upward between the finger wearing the finger ring and the adjacent finger. The slide is engaged preferably by placing the finger adjacent to the finger wearing the finger ring atop the finger tab. Preferably, the slide is engaged by applying pressure on the finger tab to press the slide against the strings, and preferably is then moved along the fretboard. Preferably, disengaging the slide comprises lifting the finger off the finger tab.

A primary object of the present invention is to prevent over-rotation of the slide during play.

Another object of the present invention is to facilitate firm pressure across the slide when in playing position.

A further object of the present invention is to provide a slide that allows the player to switch between fingered play and slide play without loss in timing.

Yet another object of the present invention is to provide a slide that automatically moves out of the way of fingers when not in use.

Still a further object of the present invention is to provide a slide that allows the fingers to remain free for dampening vibrations.

A primary advantage of the present invention is the ability to position the slide into and remove the slide from playing position without loss of timing.

Another advantage of the present invention is the light weight of the slide.

A further advantage of the present invention is the ability to place the slide without causing unwanted string noise.

Yet another advantage of the present invention is the precise control afforded by the unique design of the slide.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

Figure 1:
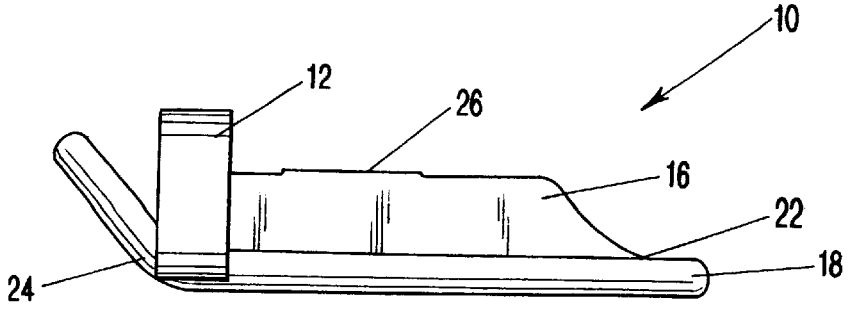
FIG. 1 is a side view of a preferred embodiment of the present invention, showing all components.
Figure 2:
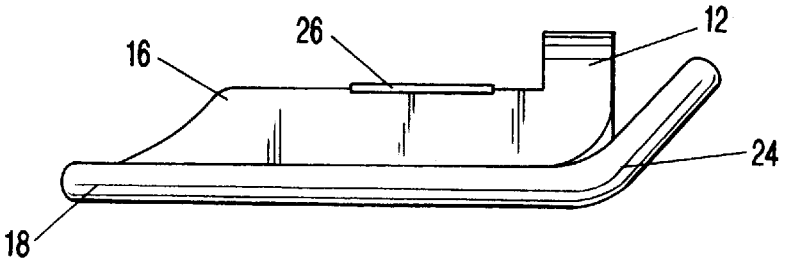
FIG. 2 is a side view of a preferred embodiment of the present invention from the finger tab side.
Figure 3:
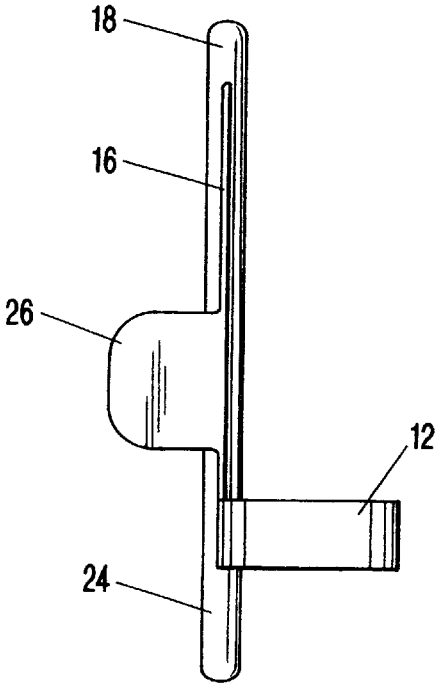
FIG. 3 is a top view of a preferred embodiment of the present invention for a right-handed player.
Figure 4:
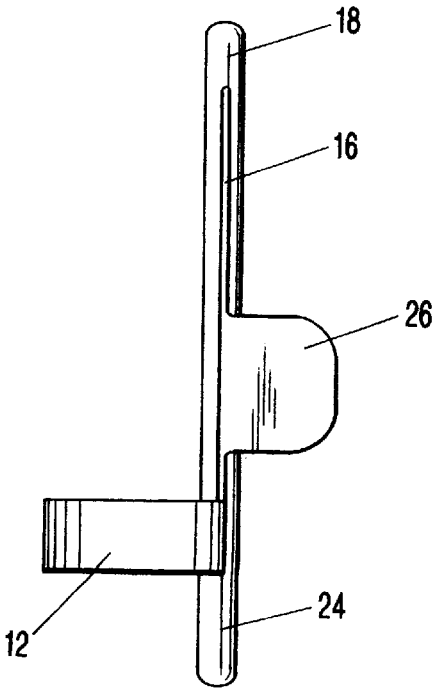
FIG. 4 is a top view of a preferred embodiment of the present invention for a left-handed player.
Figure 5:
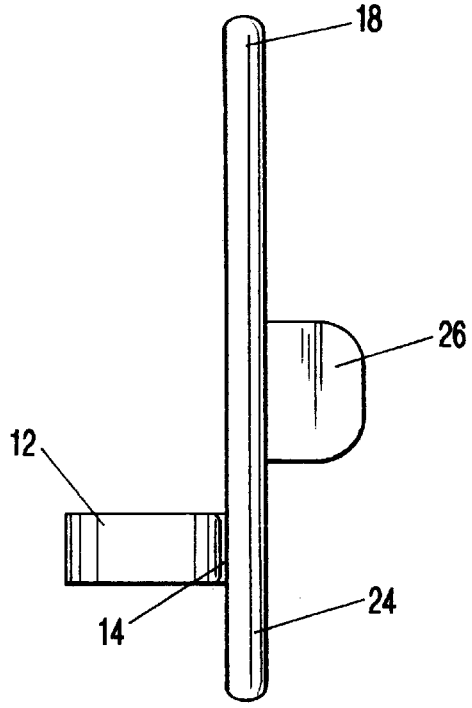
FIG. 5 is a bottom view of a preferred embodiment of the present invention.
Figure 6:
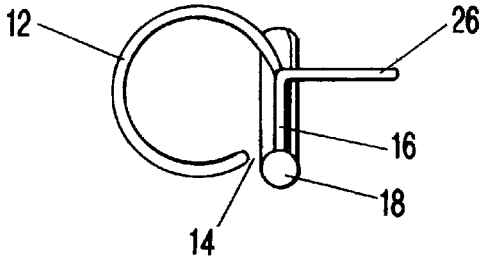
FIG. 6 is an end view of a preferred embodiment of the present invention showing the ring gap.
Figure 7:
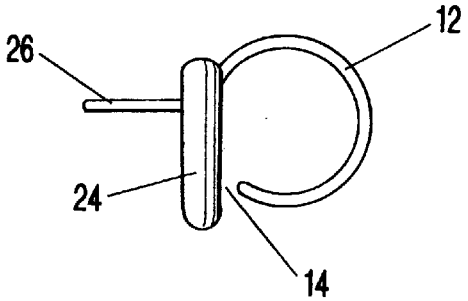
FIG. 7 is an end view of a preferred embodiment of the present invention showing the bend extension.
Figure 8:
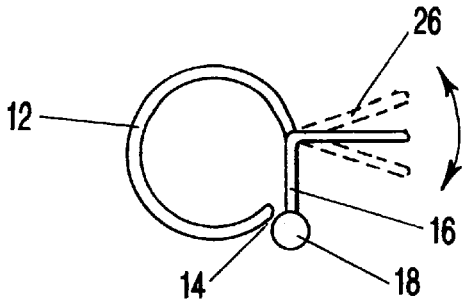
FIG. 8 is and end view of a preferred embodiment of the present invention showing the adjustability of the finger tab.
Figure 9:
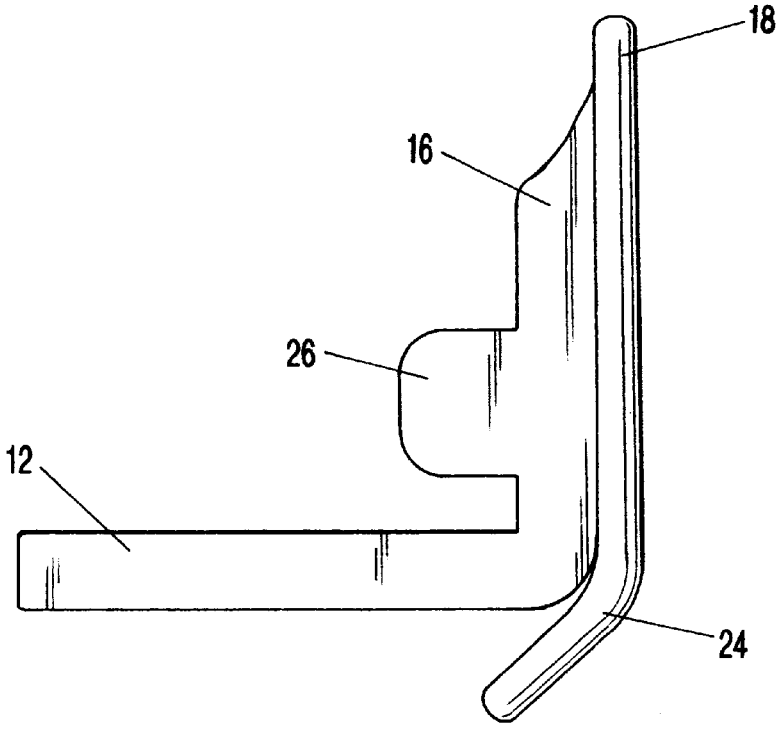
FIG. 9 is a top view of a preferred embodiment of the present invention prior to forming the ring curve.
Figure 10:
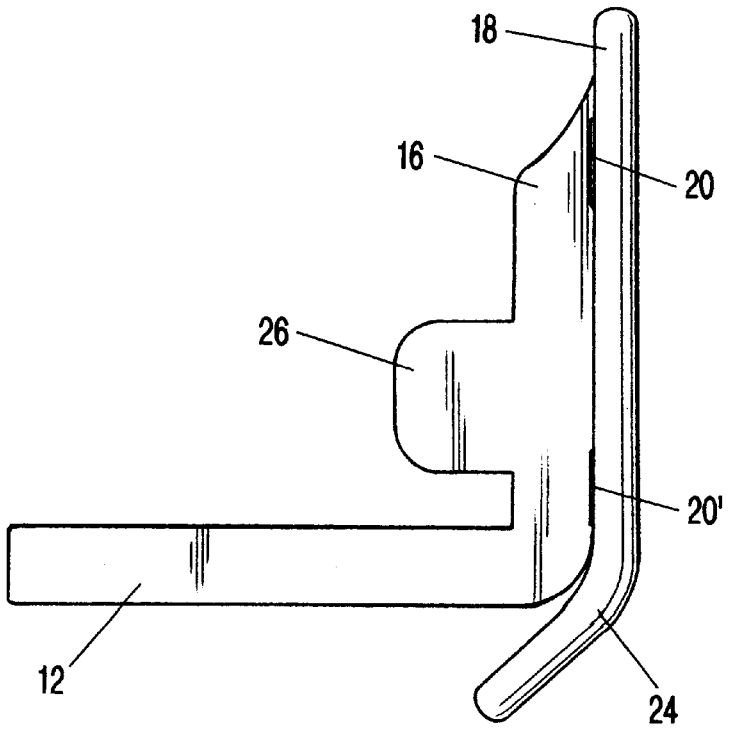
FIG. 10 is a top view of a preferred embodiment of the present invention showing potential attachment points of the slide bar to the bar support rail.

Best Modes for Carrying out the Invention

In a preferred embodiment of the present invention, as shown in FIGS. 1–10, slide 10 comprises finger ring 12 preferably having gap 14 in the circumference for adjustability. Finger ring 12 is attached to side of bar support rail 16. Bar support rail 16 is centered over and is attached to slide bar 18, preferably by welding, soldering, brazing, or other permanent attachment to at least one attachment point 20, and preferably two points 20, 20'. Where bar support rail 16 is attached to slide bar 18, rail 16 is preferably curved for a more comfortable fit. Alternatively, bar support rail 16 is continuously attached along its entire length to slide bar 18. Preferably, bar support rail 16 is sloped downward to slide bar 18 at fingertip end 22. Slide bar 18 has bend extension 24 leading upward from slide bar 18 beyond finger ring 12, to extend upward between fingers and thus prevent over-rotation of slide 10. Also included is finger tab 26. Finger tab 26 is bent in the opposite direction of finger ring 12 to an angle of approximately 90° to support rail 16. Finger tab 26 may, in one embodiment, be bent to adjust amount of pressure exerted upon strings when slide bar 18 is engaged.

All pieces of slide 10 may comprise a malleable metal, such as brass or bronzite, depending upon tonal quality desired. Brass produces a brighter, more resonant tone, while steel or chrome typically produce a bright, clear tone. Alternatively, all parts may be made of other substances, such as stainless steel, cold-rolled sheet metal, or any other substance.

INDUSTRIAL APPLICABILITY

The invention is further illustrated by the following non-limiting examples.

EXAMPLE 1

Figure 11:
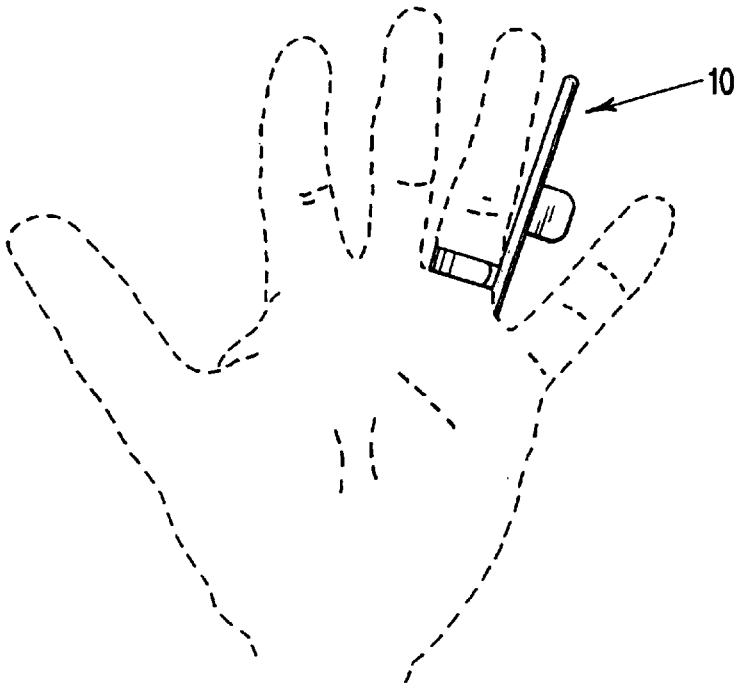
FIG. 11 is a palm view of a preferred embodiment of the present invention around a player's finger.
Figure 12:
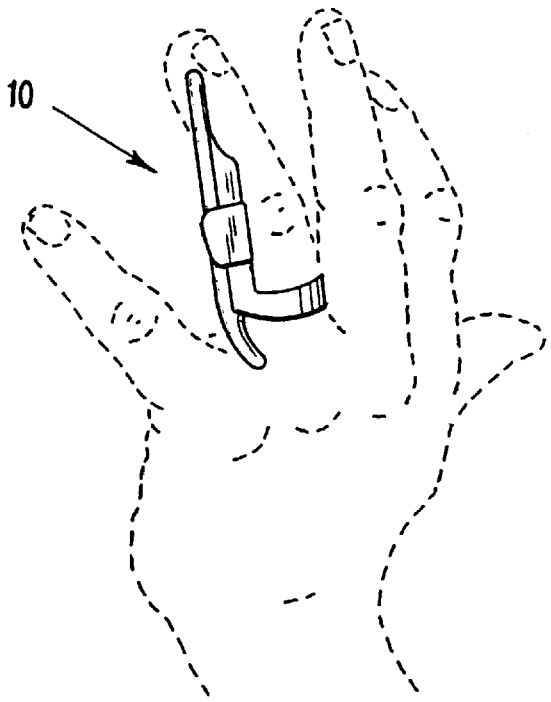
FIG. 12 is a top perspective view of a preferred embodiment of the present invention.
Figure 13:
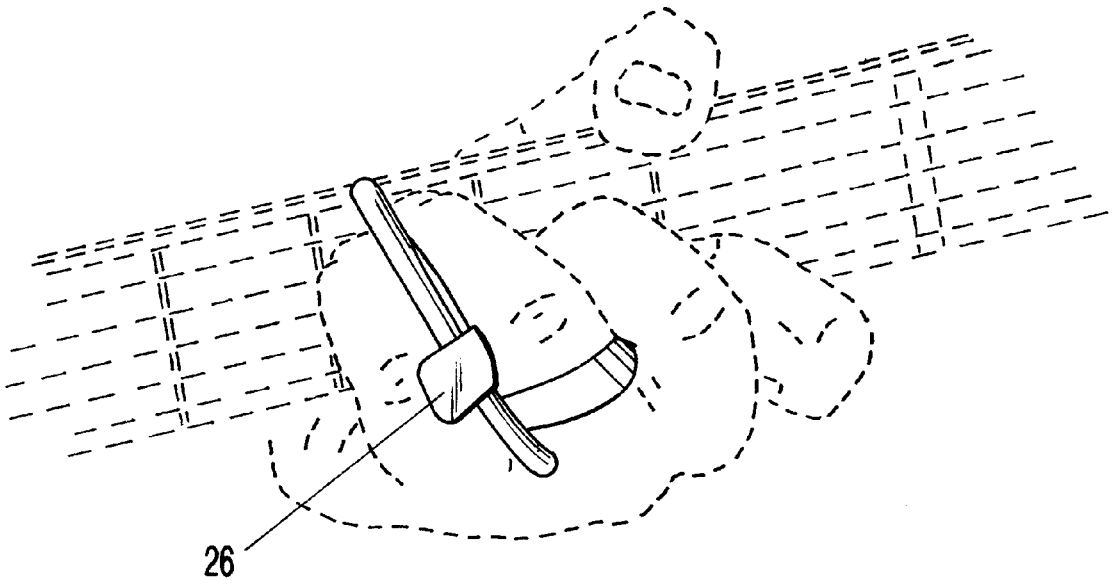
FIG. 13 is a perspective view of a preferred embodiment of the present invention showing positioning while playing with the slide disengaged.
Figure 14:
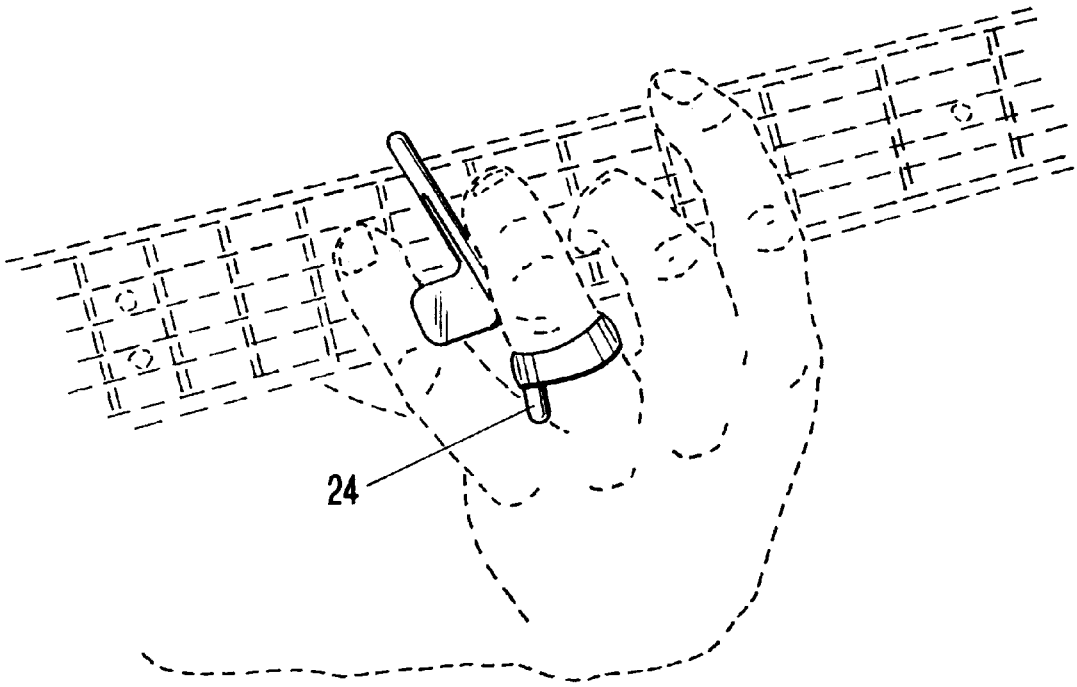
FIG. 14 is a perspective view of a preferred embodiment of the present invention showing positioning while player is beginning to engage the slide.
Figure 15:
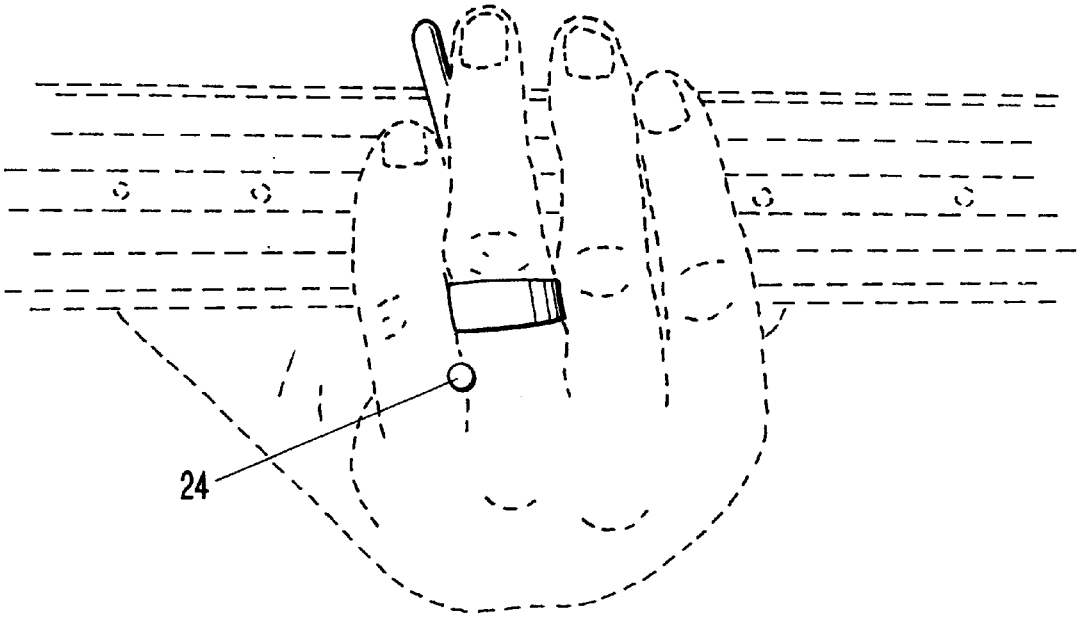
FIG. 15 is a perspective view of a preferred embodiment of the present invention showing positioning of the fingers with the slide engaged.
Figure 16:
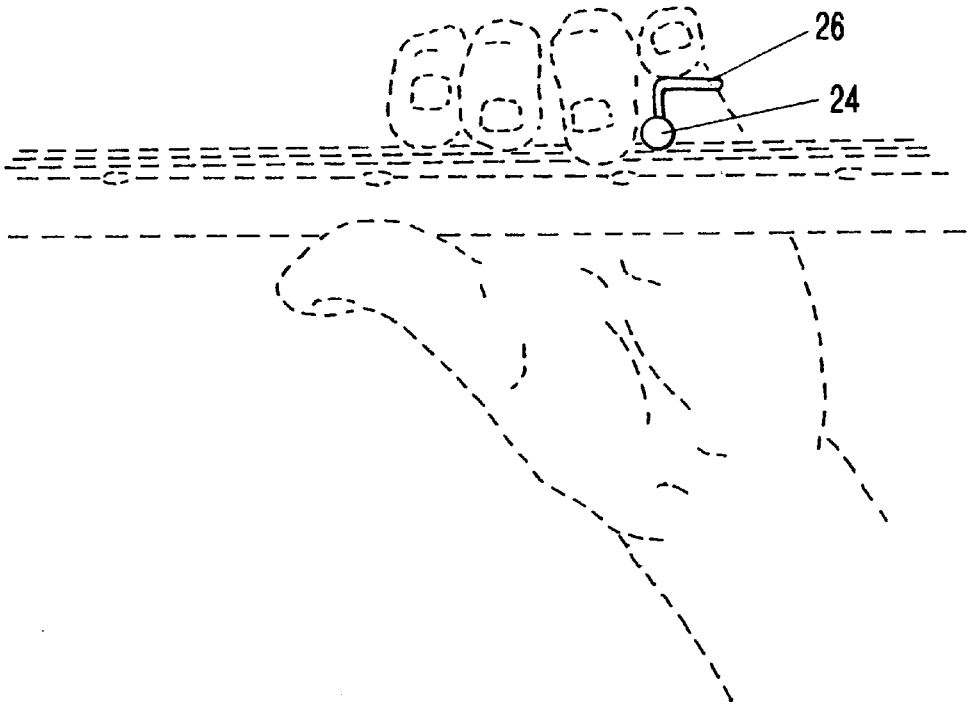
FIG. 16 is a side perspective view of a preferred embodiment of the present invention showing positioning with the slide engaged.

In use, the slide allows production of traditional slide guitar sounds, including warbling and shimmying, at the "snap of a wrist." The player places the slide on the ring finger of the fingering hand (although other fingers may be used), resting the bend extension on the top side of the hand between the ring finger and little finger, as shown in FIGS. 11 and 12. This placement of the bend extension prevents the slide from rotating, especially to the underside of the ring finger. The finger ring is initially adjusted in circumference to provide a snug fit. The fingers remain free to perform normal fingered playing, as shown in FIG. 13. When slide play is desired, the player brings the little finger (or finger next to whichever finger the ring is placed upon) around the finger tab, as shown in FIG. 14, and places the little finger on the tab to apply pressure and force the slide bar down onto the strings, as shown in FIG. 15. The other fingers can be used to dampen noise, as shown in FIG. 16. The design of the slide allows for light-weight construction, and additionally reduces or eliminates the unwanted striking noise of the slide hitting the fretboard too hard.

When fingered play is again desired, the player simply lifts the little finger off the finger tab. The placement and weight of the bend extension then causes the entire slide to move upward and out of the way of normal fingered play, without requiring any additional manipulations or adjustments. Consequently, there is no break in timing incurred during the conversion between fingered and slide play.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An apparatus for slide-play of a stringed instrument, said apparatus comprising:

a finger ring;

a bar support rail attached to a side of said finger ring;

a slide bar attached to said bar support rail;

a bend extension on an opposite side of said finger ring from said slide bar and rising upward from said slide bar and integral to said slide bar; and a finger tab adjacent to said finger ring and extending laterally from said finger ring.

2. The apparatus of claim 1 wherein said finger ring comprises a sizably adjustable band.

3. The apparatus of claim 2 wherein said sizably adjustable band comprises an incomplete circumference.

4. The apparatus of claim 1 wherein said bar support rail is integral with said finger ring.

5. The apparatus of claim 1 wherein said bar support rail comprises a triangularly pointed slope at the end opposite said finger ring.

6. The apparatus of claim 1 wherein said slide bar comprises a solid cylindrical bar.

7. The apparatus of claim 1 wherein said slide bar is attached by at least two points to said bar support rail.

8. The apparatus of claim 7 wherein said slide bar is attached along the entire length of said bar support rail.

9. The apparatus of claim 1 wherein said slide bar attachment to said bar support rail comprises at least one attachment means selected from the group consisting of solder, bronzing and brazing.

10. The apparatus of claim 1 wherein said slide bar is integral with said bar support rail.

11. The apparatus of claim 1 wherein said bend extension angles upward proximal to said finger ring.

12. The apparatus of claim 1 wherein said finger tab is integral with said bar support rail.

13. The apparatus of claim 1 wherein said finger tab is adjustable.

14. The apparatus of claim 1 wherein said finger tab extends at an angle of approximately 90° to said slide bar.

15. The apparatus of claim 1 wherein said apparatus comprises at least one composition selected from the group consisting of steel, chrome, brass, sheet metal, glass, ceramics, and compound plastics.

16. A method of playing a stringed instrument with a slide, the method comprising the steps of:

a) placing a slide comprising a finger tab, a slide bar, and a bend extension on a finger of the hand that utilizes a fretboard of the stringed instrument, wherein the bend extension is on an opposite side of the finger ring from the slide bar and rises upward from the slide bar and is integral to the slide bar;

b) engaging the slide on the fretboard; and c) disengaging the slide to allow for fingered playing.

17. The method of claim 16 wherein the step of placing a slide comprising a finger tab and a bend extension comprises placing a slide attached to a finger ring.

18. The method of claim 17 wherein the step of placing a slide comprises placing a slide attached to an adjustable finger ring.

19. The method of claim 18 further comprising the step of adjusting the finger ring.

20. The method of claim 16 wherein the step of placing a slide comprises placing a slide with the bend extension extending upward between the finger wearing the finger ring and the adjacent finger.

21. The method of claim 16 wherein the step of engaging the slide comprises engaging by placing the finger adjacent to the finger wearing the finger ring atop the finger tab.

22. The method of claim 21 wherein the step of engaging the slide comprises engaging by applying pressure on the finger tab to press the slide against the strings.

23. The method of claim 22 wherein the step of engaging the slide comprises moving the slide along the fretboard.

24. The method of claim 16 wherein the step of disengaging the slide comprises lifting the finger off the finger tab.

* * * * *